US010897969B1

(12) United States Patent
Chargois

(10) Patent No.: US 10,897,969 B1
(45) Date of Patent: Jan. 26, 2021

(54) REVERSIBLE CABLE STORAGE POUCH WITH INTERNAL IN-LINE CATCHES

(71) Applicant: THE BANANA BUNGEE LLC, Katy, TX (US)

(72) Inventor: Trevor A. Chargois, Katy, TX (US)

(73) Assignee: THE BANANA BUNGEE LLC, Katy, TX (US)

( * ) Notice: Subject to any disclaimer, the term of this patent is extended or adjusted under 35 U.S.C. 154(b) by 0 days.

(21) Appl. No.: 16/906,448

(22) Filed: Jun. 19, 2020

Related U.S. Application Data

(63) Continuation-in-part of application No. 16/388,431, filed on Apr. 18, 2019, now Pat. No. 10,812,883.

(60) Provisional application No. 62/661,240, filed on Apr. 23, 2018.

(51) Int. Cl.

| | |
|---|---|
| ***H04R 1/10*** | (2006.01) |
| ***A45C 11/00*** | (2006.01) |
| ***A45C 3/00*** | (2006.01) |
| ***A45C 7/00*** | (2006.01) |

(52) U.S. Cl.
CPC ..... *A45C 3/001* (2013.01); *A45C 7/0059* (2013.01); *H04R 1/1033* (2013.01); *A45C 2011/001* (2013.01)

(58) Field of Classification Search
CPC ..... H04R 1/1033; A45C 3/001; A45C 7/0059; A45C 2011/001
See application file for complete search history.

(56) References Cited

U.S. PATENT DOCUMENTS

| | | | | |
|---|---|---|---|---|
| 2003/0124948 | A1 | 7/2003 | Ostolaza | |
| 2016/0220000 | A1* | 8/2016 | McGuckin | A45C 11/00 |
| 2016/0261947 | A1 | 9/2016 | Ito et al. | |

* cited by examiner

*Primary Examiner* — Sunita Joshi

(57) ABSTRACT

Disclosed is a reversible compact pouch with internal cable-catches comprised of a light-weight material design that remains unobtrusively attached to cabled devices (such as an earbud listening device, albeit not limited to such). The permanently attached cable-catches can open and securely bind various cables, collectively making the pouch readily available when needed to collect and bundle cable attached thereto.

20 Claims, 5 Drawing Sheets

200

200

FIG. 3A
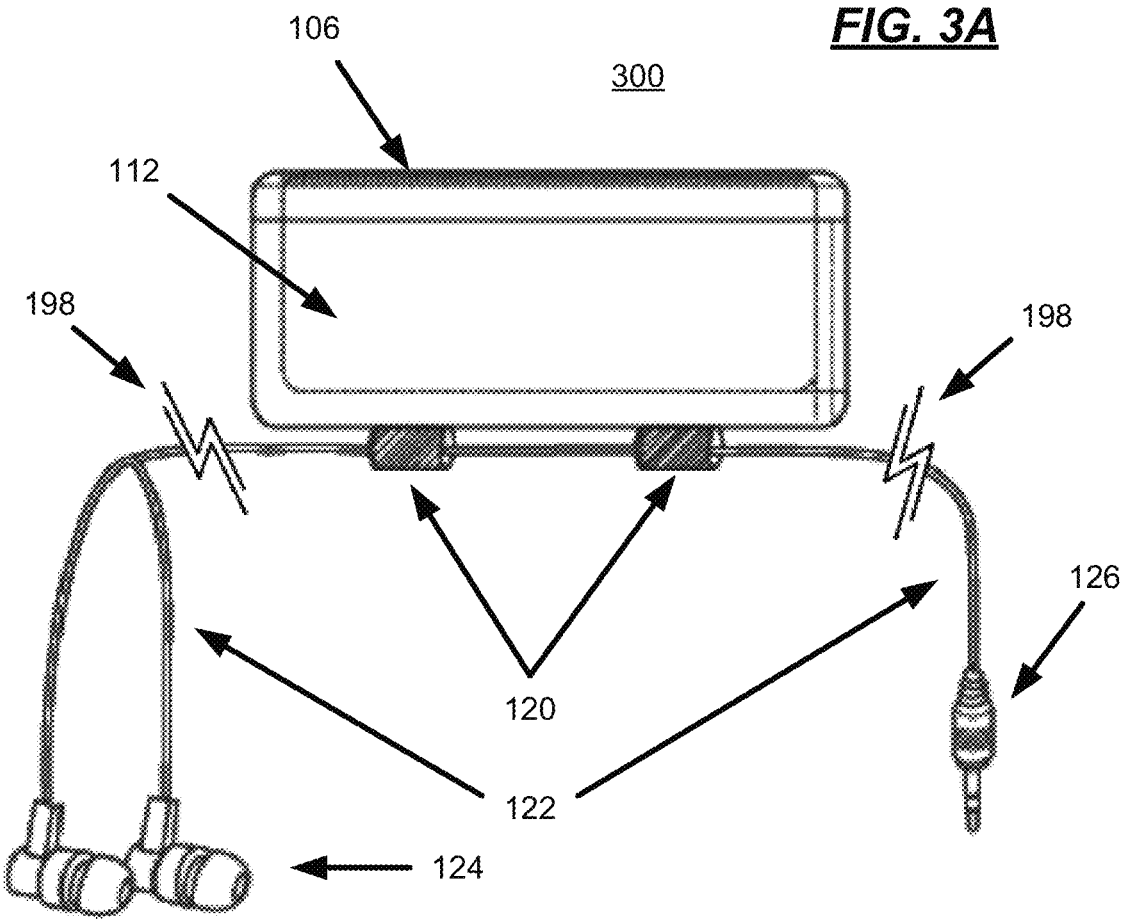
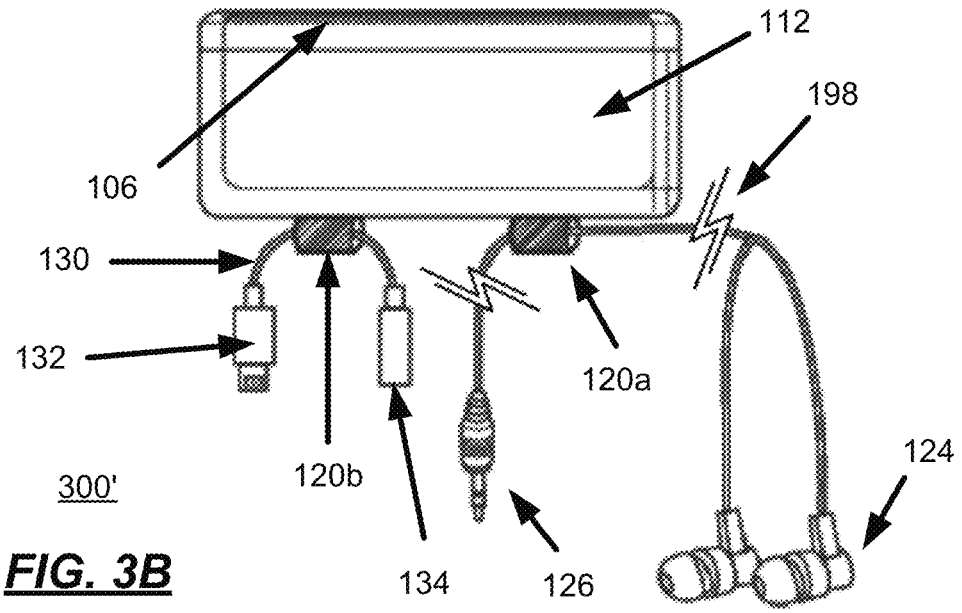
FIG. 3B

REVERSIBLE CABLE STORAGE POUCH WITH INTERNAL IN-LINE CATCHES

CROSS-REFERENCE TO RELATED APPLICATIONS

This application claims benefit of and priority to, and incorporates herein by reference in its entirety, U.S. patent application Ser. No. 16/388,431 filed Apr. 18, 2019, titled "REVERSIBLE CABLE STORAGE POUCH WITH INTERNAL IN-LINE CATCHES", which in turn claims benefit of and priority to, and incorporates herein by reference in its entirety, U.S. Provisional Application No. 62/661,240, filed Apr. 23, 2018, titled "REVERSIBLE COMPACT ZIPPER EARBUD POUCH WITH INTERNAL CABLE-CATCHES".

BACKGROUND

As known and appreciated by skilled artisans, products and components with long wires, cables, or cords—such as the power cord for a personal electronic device, the line from charging tip to a charger base or AC/DC transformer, or the signal-transmitting wires for wired headphones and/or microphones—are common in electronic products and devices. Indeed, there are many consumer and commercial products and devices that utilize wires, cables, and cords that need to be deployed for use but which subsequently need to be collected, bundled, stored, and ready for easy extraction and deployment for later use.

This use-store-use-store-use cycle of certain wires, cables, and cords would be greatly enhanced and facilitated by utilization of a cable management system. For example, storing device power-cords, auxiliary cables, or wired headphone cables has been an ongoing challenge with typical methods of storage based on some variation of manually coiling cable to-and-fro until most has been collected together followed by wrapping the cable collection with either a small but strategic length of the cable itself (held back specifically for this purpose) or by using separate/additional wire wraps, ties, or bands to assist in this final wrapping process. These other third-party wrap solutions do exist in the form of tying cords, twist ties, plastic zip-ties, and other similar fixtures. The use of these third-party wraps is accomplished by maintaining them nearby to where the collection activity might occur or, in some cases, they might be affixed in some form to the wire itself.

Once bundling has been achieved the cables and/or devices may then be stored. The storage process is further facilitated by keeping or maintaining the wires properly bound during storage, that is, where the gathered cable is stored in a pocket, purse, drawer, backpack, or other containment. However, for more general storage compartments, the redeployment of the wire or cable may be hindered by the need to first uncover the cable or remove other objects that have been piled on top of the cable. Moreover, third party wraps or ties might also fail to keep the bundle compact and self-contained and could lead to entangling with other items stored in the same general storage compartment, thereby posing yet another challenge during extraction for reuse.

Additionally, there are also other commercial products—with limiting factors of their own—that might provide self-coiling or assisted-coiling components incorporating wheels, reels, springs, or other configurations for recoiling and storing wires, cables, or cords when not in use. However, while self-coiling components reduce the requirements for third party ties or wraps, they generally require an internal-coil of some sort that is susceptible to wearing-out or malfunctioning and oftentimes require substantially more space for storage than just the cabled device itself.

Accordingly, there remains a need for a simple storage solution for wires, cables, cords, and lines where said storage enables both rapid deployment of a cable for use as well as easy and efficient storage of the cable when not in use in order to better address the conundrum of effectively and efficiently storing and utilizing cable-based device (such as earbuds) given that solutions available today are inadequate.

SUMMARY

Disclosed herein are various implementations of an enhanced storage system (ESS) comprising a reversible cable storage pouch with internal in-line catches wherein the ESS remains in-line with the cable and unobtrusive when in use. Certain such implementations may be specifically directed to ESSs having a reversible compact zipper earbud pouch having internal cable-catches. These various implementations become an attachable and physically coupled part of the cable while at the same time keeping all needed implements within instant proximity. In this manner, the various implementations help achieve a flexible attachment mechanism for various devices such as earbuds while providing a manageable collection process, clean storage, and easy extraction.

More specifically, disclosed herein are various implementations directed to an apparatus comprising a reversible pouch having one or more attachments fixedly coupled to said reversible pouch for engaging a cable, wherein said reversible pouch is capable of completely enveloping the cable and the attachments when in a standard configuration, and wherein said apparatus is capable of deploying substantially all of the cable through an opening in the reversible pouch while in the standard configuration. For several such implementations, the apparatus may be capable of maximally exposing the cable and the attachments when deployed in a reversible configuration, wherein the one or more attachments may be quickly disengaged from the cable and/or wherein at least one attachment is a hook-and-loop fastener forming either a loop through which the cable passes and is engaged or a cover that permits a channel through which the cable passes and is engaged. For certain such implementations, the reversible pouch may be a zippered pouch, a hook-and-loop fastener pouch, a buttoned pouch, or a snapped pouch where the storage capacity of the pouch in the reversible configuration is substantially the same as the storage capacity of the pouch in the standard configuration, wherein the attachments is capable of covering less than ten percent (10%) of the cable when the cable is deployed in the standard configuration and covering all of the cable when the cable is stored within the apparatus, and/or wherein the reversible pouch is capable of covering less than twenty percent (20%) of the cable when the cable is deployed in the standard configuration and covering none of the cable when the cable is deployed in the reversible configuration.

For select implementations, the attachments may comprise a cable-engaging surface that limits slippage of the apparatus when the cable is deployed in the standard configuration or in the reversible configuration; the first attachment may be capable of being disengaged from the cable while a second attachment remains engaged with the cable; a separate storage compartment capable of storing an additional item may be included; and/or the exterior surface of the reversible pouch may be marked with a first brand-identification and the interior surface of the reversible pouch may be marked with a second brand-identification that is the same as or different than the first brand identification, wherein the first brand-identification may comprise a name, a logo, an instruction, a disclaimer, a message, or a general marking, and wherein the second brand-identification may comprise a name, a logo, an instruction, a disclaimer, a message, or a general marking.

This summary is provided to introduce a selection of concepts in a simplified form that are further described below in the detailed description. This summary is not intended to identify key features or essential features of the claimed subject matter, nor is it intended to be used to limit the scope of the claimed subject matter.

BRIEF DESCRIPTION OF THE DRAWINGS

The foregoing summary and the following detailed description of illustrative implementations are better understood when read in conjunction with the appended drawings. For the purpose of illustrating the implementations, there is shown in the drawings example constructions of the implementations; however, the implementations are not limited to the specific methods and instrumentalities disclosed. In the drawings:

FIG. 3A is an illustration of the external side view of the ESS with its pouch in the reversible configuration with cable attachments fully exposed and physically engaging a cabled device (specifically, wired earbud headphones) in a manner representative of various implementations herein disclosed;

FIG. 3B is an illustration of the external side view of the ESS with its pouch in the reversible configuration with cable attachments fully exposed and physically engaging a both a cabled device (specifically, wired earbud headphones) and an adapter device in a manner representative of various implementations herein disclosed.

DETAILED DESCRIPTION

Figure 1A:
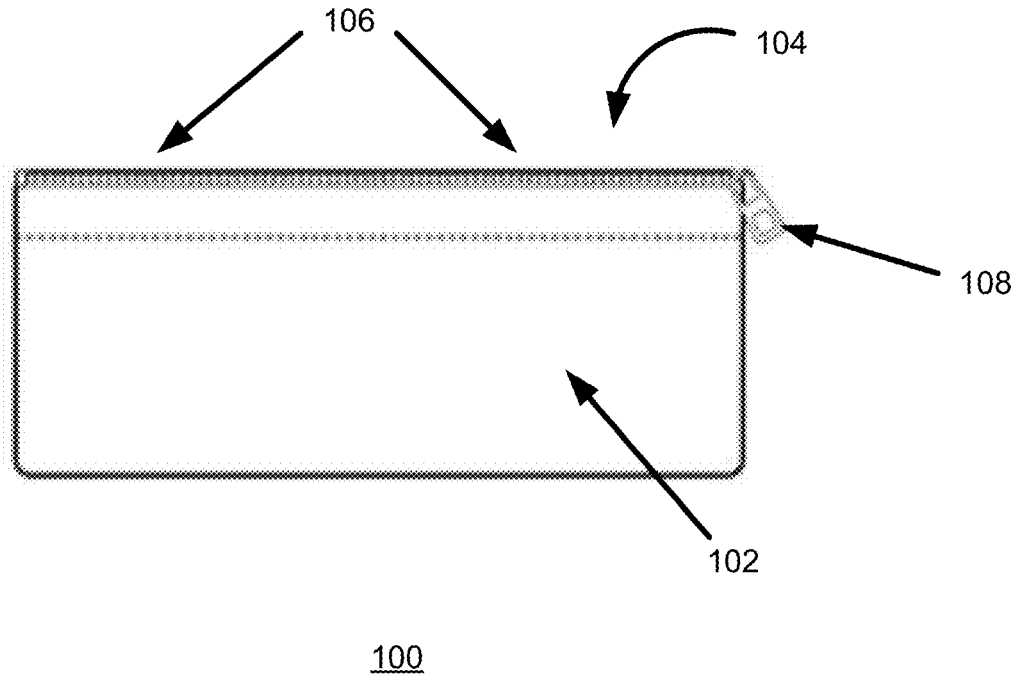
FIG. 1A is an illustration of the external side view of an enhanced storage system (ESS) representative of various implementations herein disclosed.

Disclosed herein are various implementations of a reversible compact pouch used to facilitate easy storage and retrieval of earbuds where the pouch remains an integral part of the earbud cable while in use in a manner facilitated by cable-catches that are permanently affixed within the light-weight stretchable fabric. By reversing onto the bundled earbud cable and zipped closed, controlled storage is achieved. Various concepts helpful to more fully understand and appreciate these various implementations are herein described in support of the disclosures specifically pertaining to these various implementations that follow.

The terms "wires," "cables," "cords," "lines," and various equivalents and alternatives are used interchangeably herein where the use of any one term or its equivalents should be deemed to include all of the other terms in the alternative. Furthermore, the term "cable," for example, may be used to refer to a wire used to facilitate an electronic connection—such as an auxiliary cable used to connect to a cell phone or any other auxiliary device such as a port to car audio system—but should not be interpreted as in any way limited to such use but instead should be interpreted as broadly as reasonable. Also as used herein, the term "cable-catches" should be broadly interpreted to define and describe the part of the invention used to attach to wire or cables but which can be opened to release the cable without requiring the cable to be withdrawn laterally such that one or the other end of the cable must to pass through said wire attachment.

As known and appreciated by skilled artisans, cables of various sorts can be used to facilitate an assortment of electrical connections for power transmission, signal propagation, signal capture (in the context of an antenna), and so forth between two non-wire functional components. For example, a wired headphone or earbud cable facilitates the connection from the ear-engaging component to a utilized device such as a cell phone, computer, personal media player, or any other sound transmitting device. However, cables are not limited to power or signal conveyance, and nothing herein this disclosure is intended in any way to preclude implementations for cables used for purposes other than electrical in nature. Nevertheless, for simplicity, various implementations disclosed herein are described in the exemplary context of a wired set of earbuds.

Various implementations disclosed herein of an enhanced storage system (ESS) enable cable-based consumer devices (such as earbuds) that require said cables to be extended during use with the ability to collect, effectively store, and later retrieve when needed said cables, all without the need for third party components. More specifically, disclosed is a reversible compact zipper earbud pouch with internal cable-catches comprised of a light-weight material design that remains unobtrusively attached to cabled devices such as an earbud listening device but not limited to same. The design is compact and comprises material is both light-weight and stretchable. The light-weight fabric facilitates the device being unobtrusive during usage. While stretchable fabric helps it be both unobtrusive and totally envelopes the desired cable or cabled device all within a compact pouch. The permanently attached cable-catches can open and securely bound various cables; collectively making it readily available during time of collection and bundling cable.

Storage of same is kept self-contained, unobstructed an easily extracted from varied storage area.

As such, several such implementations disclosed herein may comprise a stretchable lightweight fabric forming a compact pouch. The internal lower-ribbed seam of the pouch having two permanently affixed cable-catches designed to open and attach to the earbud cable. The pouch is also designed to be reversible and configured with a zipper to enable easy opening and reversing (exposing the storage area within), exposing the inner seam and pocket area for bundled cable and then closing (securely wrapping and holding the contents—wire or cable). The pouch size can be designed and made in differing sizes and with specific tolerances depending upon activity or device-cable requirements. It is a light-weight material design that remains unobtrusive during cable use and is readily at hand during time of collection and storage. As it completely wraps the cable, the flexible/stretchable zippered enclosure keeps the earbud cable self-contained and safe from entanglement.

FIG. 1A is an illustration of the external side view of an enhanced storage system (ESS) 100 representative of various implementations herein disclosed. As shown in FIG. 1A, the ESS 100 comprises a pouch 102 with an opening 104 for access to the interior of the pouch, said opening utilizing some sort of closing feature such as a zipper 106 comprising a clasp 108 as shown in the present example. When the zipper 106 or other closing feature holds the pouch opening 104 in a closed configuration, the contents of the ESS 100 are secured for storage within the pouch 102.

Figure 1B:
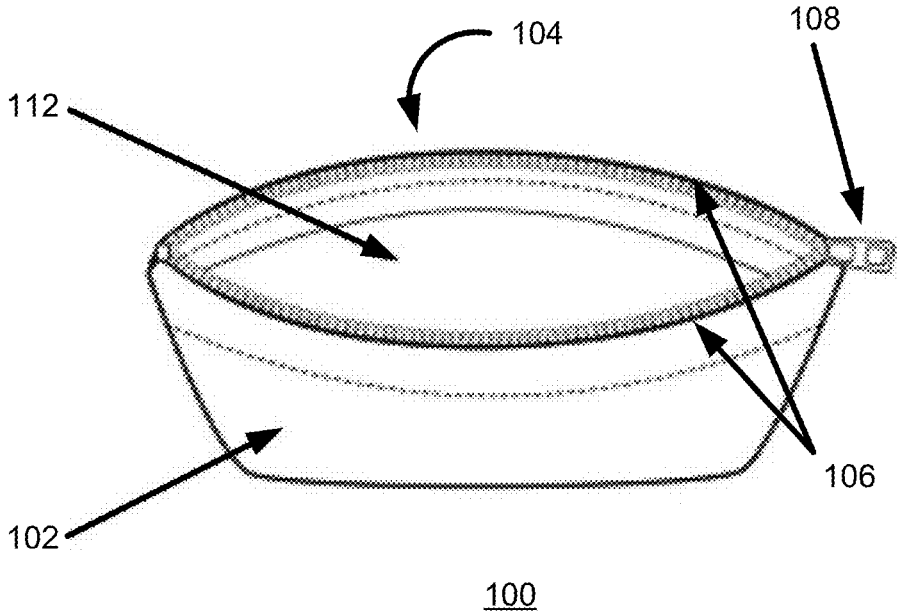
FIG. 1B is an illustration of a angled perspective view of the ESS in an opened configuration representative of various implementations herein disclosed.

FIG. 1B is an illustration of an angled perspective view of the ESS 100 in an opened configuration representative of various implementations herein disclosed. In FIG. 1B, the zipper 106 or other closing feature is in an open configuration, exposing the interior 112 of the pouch 102, and when the zipper 106 or other closing feature is manipulated so that the pouch opening 104 is in a closed configuration (not shown) the contents of the ESS 100 are secured for storage within the pouch 102.

Figure 1C:
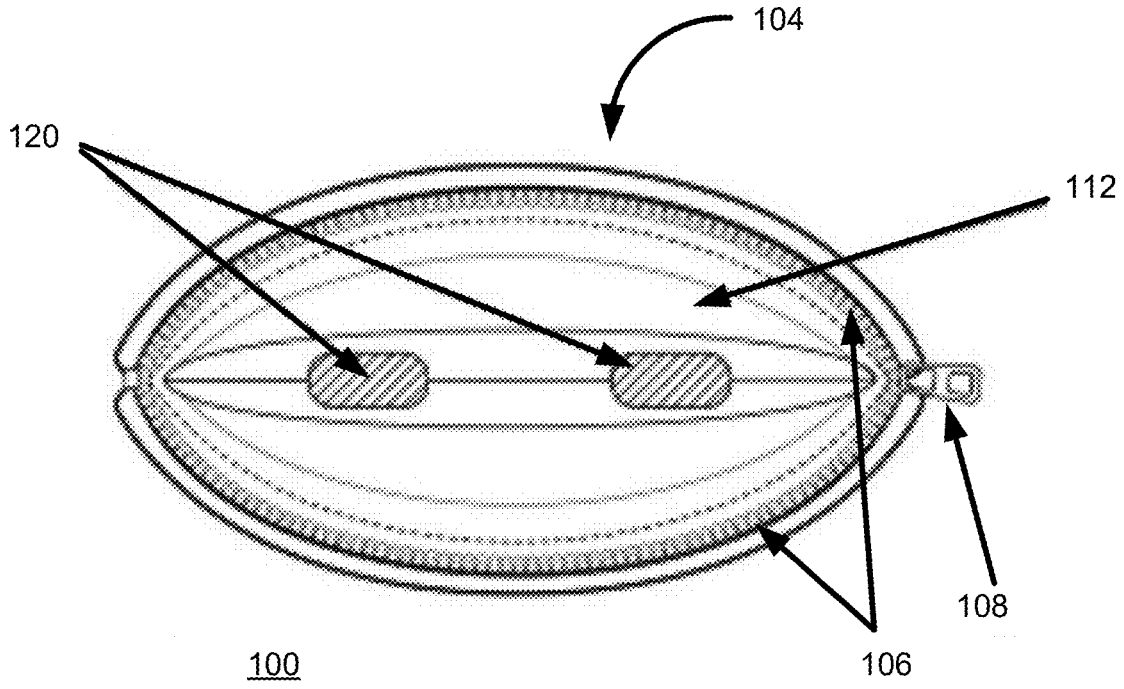
FIG. 1C is an illustration of the top view of the ESS in an opened configuration with cable attachments visible at the bottom of the interior pouch that is representative of various implementations herein disclosed.

FIG. 1C is an illustration of the top view of the ESS 100 in an opened configuration with cable attachments 120 visible at the bottom of the interior 112 of the pouch 102 that is representative of various implementations herein disclosed.

Figure 1D:
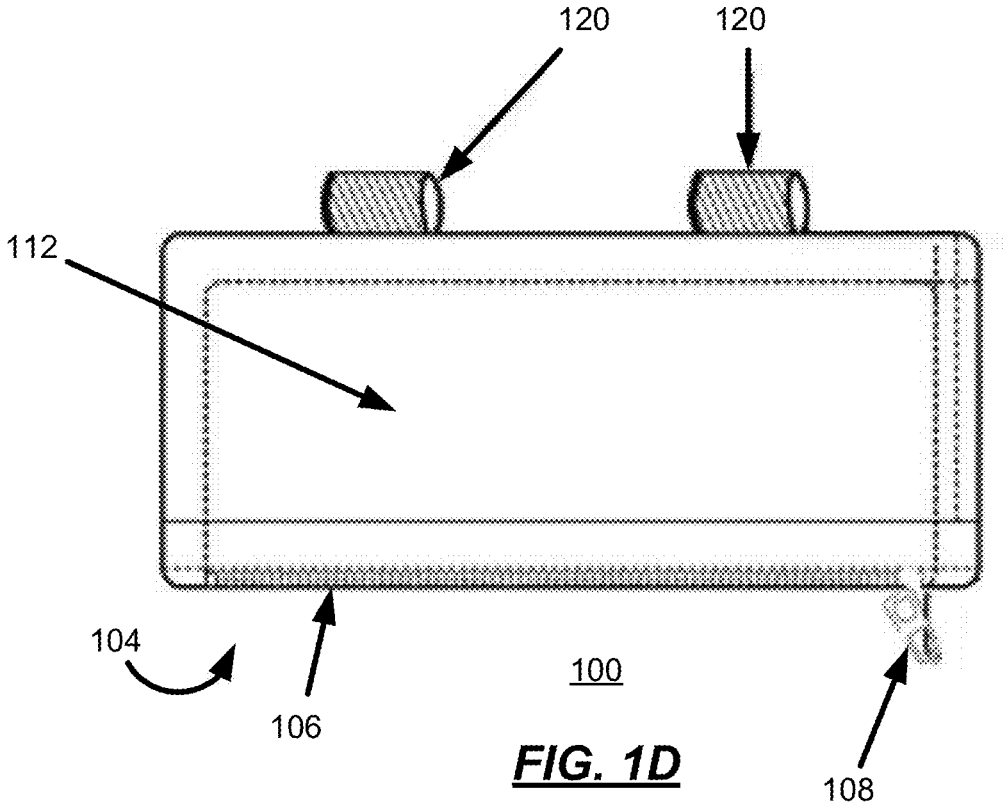
FIG. 1D is an illustration of the external side view of the ESS with its pouch in the reversible configuration with cable attachments fully exposed in a manner representative of various implementations herein disclosed.

FIG. 1D is an illustration of the external side view of the ESS 100 with its pouch 102 in the reversible configuration with the pouch's interior 112 ("interior" with regard to the standard configuration illustrated in FIGS. 1A-1C) now fully exposed externally along with the cable attachments 120 fully exposed in a manner representative of various implementations herein disclosed. Notably, for certain implementations the cable attachments 120 may comprise a hook-and-loop fastener (such as Velcro®) configured to form a open rounded channel (as shown) in an attached configuration (i.e., with the hook portion and loop portion engaged) and through which can be emplaced a cable when in an unattached configuration (i.e., with the hook portion and the loop portion not engaged but separated sufficiently apart to allow a cable to pass through). In this manner, the cable can be emplaced (engaged) or released (disengaged) with the attachments without having to pass the ends of the cable—or components coupled to the end of such cables—through the channel created by the cable attachments. Similarly, instead of creating an open rounded channel, a hook-and-loop fastener might instead be configured to sandwich a wire between the hook portion and the loop portion when in an attached configuration (i.e., with the hook portion and the loop portion engaged) and allow easy emplacement and release of the wire when the hook portion and loop portion are in an unattached configuration (i.e., with the hook portion and the loop portion not engaged but separated sufficiently apart to allow a cable to pass between them).

Figure 2A:
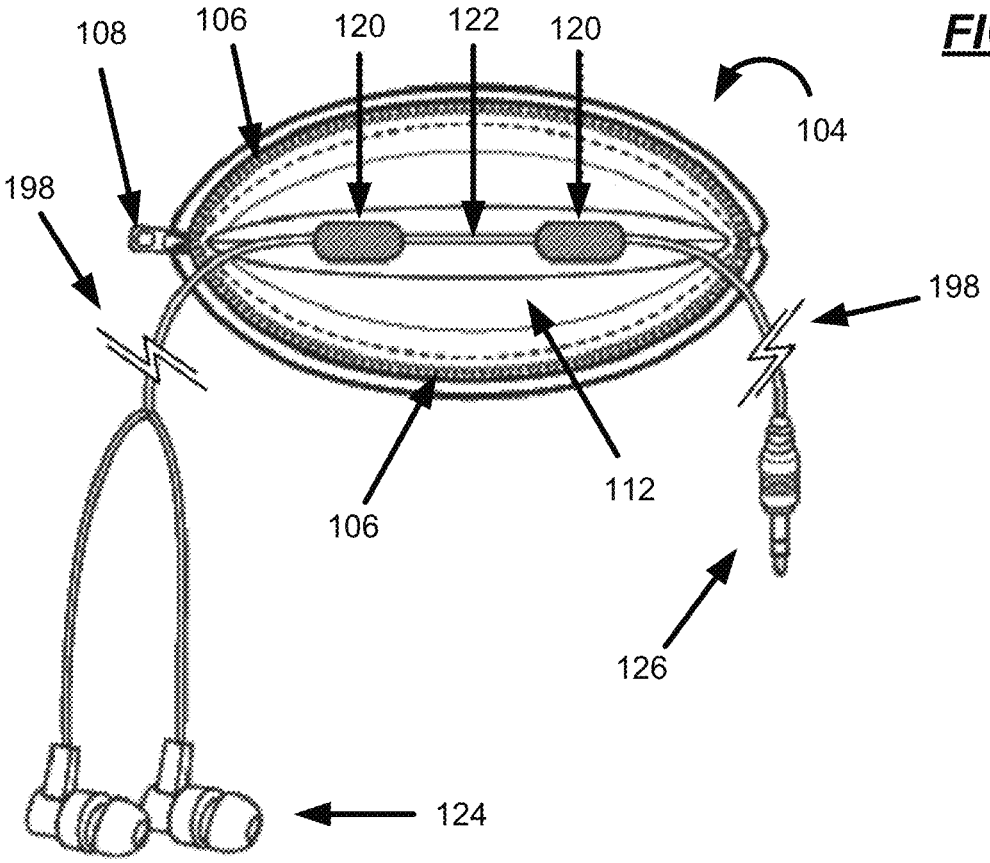
FIG. 2A is an illustration of the top view of the ESS in an opened configuration and a cabled device (specifically, wired earbud headphones) physically engaged by the cable attachments visible at the bottom of the interior pouch in a manner representative of various implementations herein disclosed.

FIG. 2A is an illustration of the top view of the ESS 200 in an opened configuration and a cabled device 122 (specifically, wired earbud headphones) physically engaged by the cable attachments 120 visible at the bottom of the interior 112 of the pouch 102 in a manner representative of various implementations herein disclosed. As shown in FIG. 2A, the cabled device 122 may comprise a length of cable terminating at one end with earbuds 124 and at the other end with a connector 126. Due to space constrains, the length of the cabled device 122 is illustrated with image breaks 198 each representing a length of cable not shown.

Figure 2B:
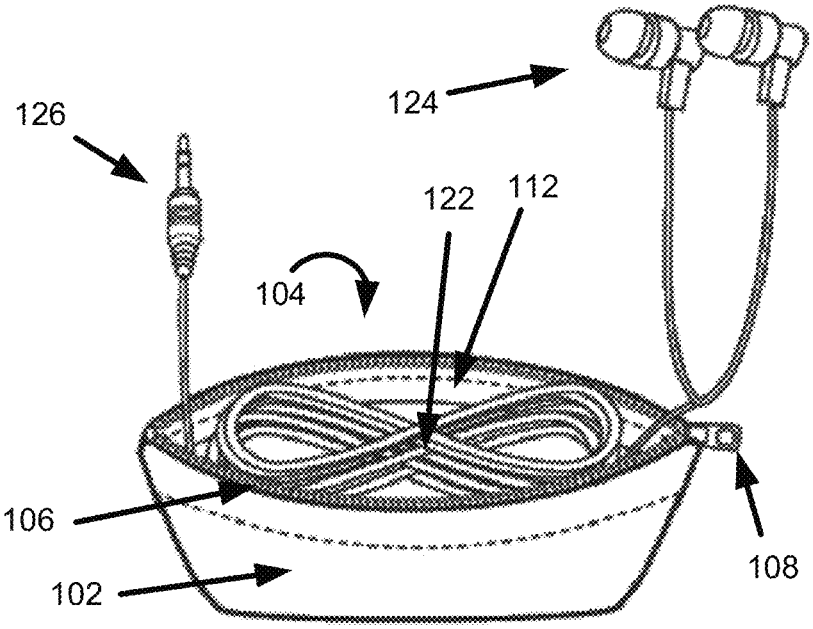
FIG. 2B is an illustration of the top view of the ESS in an opened configuration and a cabled device (specifically, wired earbud headphones) physically engaged by the cable attachments at the bottom of the interior pouch (not shown) with cable portion of the cabled device substantially stored in the ESS pouch in a manner representative of various implementations herein disclosed.

FIG. 2B is an illustration of the top view of the ESS 200 in an opened configuration and a cabled device 122 (specifically, wired earbud headphones) physically engaged by the cable attachments 120 (not shown) at the bottom of the interior 112 of the pouch 102 with the cable portion of the cabled device 122 substantially stored in the ESS pouch 102 in a manner representative of various implementations herein disclosed. In FIG. 2B, although the earbuds 124 and the connector 126 are shown outside of the pouch 102 to better view the cable portion of the cabled device 122, these components would also be stored within the pouch 102 such that when the zipper 106 or other closing feature is manipulated so that the pouch opening 104 is closed the entire cabled device 122 is stored within the pouch 102. Alternatively, the earbuds 124 and the connector 126 may be left outside the pouch when substantially all of the wired portions of the wired device 122 is stored within the pouch but where the zipper 106 or other closing feature is manipulated so that the pouch opening 104 or other closing feature is substantially closed but partially left open only just enough to permit these components to remain outside of the pouch 102.

FIG. 3A is an illustration of the external side view of the ESS 300 with its pouch in the reversible configuration with cable attachments 120 fully exposed and physically engaging a cabled device 122 (specifically, wired earbud headphones) in a manner representative of various implementations herein disclosed. As shown in FIG. 3A, in this reversible configuration, the cabled device 122 is maximally exposed and the cable attachments 120 minimally engage the cabled device 122. Furthermore, in this reversible configuration, engaging and disengaging the cable portion of the cabled device 122 with the cable attachments 120 may be more easily achieved than when the pouch 102 in the standard (non-reversed) configuration, and especially for relatively small-size implementations (such as for earbud storage).

FIG. 3B is an illustration of the external side view of the ESS 300 with its pouch 102 in the reversible configuration and with cable attachments 120 (shown here as 120*a* and 120*b* to distinguish between them) fully exposed and physically engaging a cabled device 122 (such as earbuds, as shown) and a second cabled device (such as an adapter, as shown) (specifically, wired earbud headphones) in a manner representative of various implementations herein disclosed. In this manner, the separate cable attachments 120*a* and 120*b* can be used to engage different wired devices. As such, the cable attachments 120 when utilized in series of two or more can be used individually or collectively to engage one or more wired devices.

Figure 4:
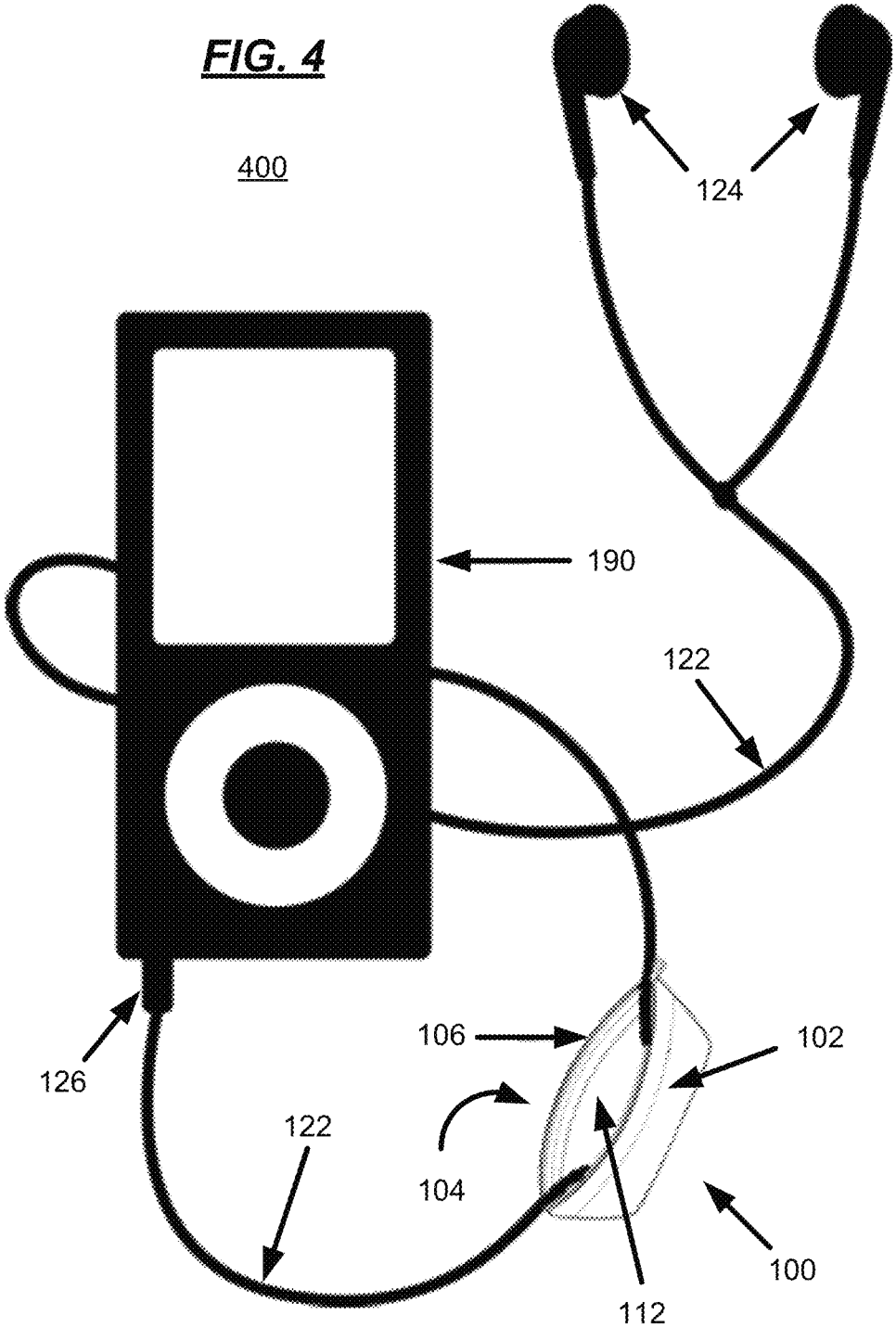
FIG. 4 is an illustration of the ESS in an opened configuration physically coupled to a cabled device (specifically, wired earbud headphones coupled to a personal media player) via cable attachments at the bottom of the pouch (not shown) in a manner representative of various implementations herein disclosed.

FIG. 4 is an illustration of the ESS 400 in an opened configuration physically coupled to a cabled device 122

(specifically, wired earbud headphones coupled to a personal media player) via cable attachments 120 at the bottom of the pouch 102 (not shown) in a manner representative of various implementations herein disclosed.

With regard to the foregoing figures, the various implementations disclosed herein may be directed to an apparatus comprising a reversible pouch having one or more attachments fixedly coupled to said reversible pouch for engaging a cable, wherein said reversible pouch is capable of completely enveloping the cable and the attachments when in a standard configuration, and wherein said apparatus is capable of deploying substantially all of the cable through an opening in the reversible pouch while in the standard configuration. For several such implementations, the apparatus may be capable of maximally exposing the cable and the attachments when deployed in a reversible configuration, wherein the one or more attachments may be quickly disengaged from the cable and/or wherein at least one attachment is a hook-and-loop fastener forming either a loop through which the cable passes and is engaged or a cover that permits a channel through which the cable passes and is engaged. For certain such implementations, the reversible pouch may be a zippered pouch, a hook-and-loop fastener pouch, a buttoned pouch, or a snapped pouch where the storage capacity of the pouch in the reversible configuration is substantially the same as the storage capacity of the pouch in the standard configuration, wherein the attachments is capable of covering less than ten percent (10%) of the cable when the cable is deployed in the standard configuration and covering all of the cable when the cable is stored within the apparatus, and/or wherein the reversible pouch is capable of covering less than twenty percent (20%) of the cable when the cable is deployed in the standard configuration and covering none of the cable when the cable is deployed in the reversible configuration.

For select implementations disclosed herein, the attachments may comprise a cable-engaging surface that limits slippage of the apparatus when the cable is deployed in the standard configuration or in the reversible configuration; the first attachment may be capable of being disengaged from the cable while a second attachment remains engaged with the cable; a separate storage compartment capable of storing an additional item may be included; and/or the exterior surface of the reversible pouch may be marked with a first brand-identification and the interior surface of the reversible pouch may be marked with a second brand-identification that is the same as or different than the first brand identification, wherein the first brand-identification may comprise a name, a logo, an instruction, a disclaimer, a message, or a general marking, and wherein the second brand-identification may comprise a name, a logo, an instruction, a disclaimer, a message, or a general marking.

For various implementations, the pouch may be constructed of a stretchable and lightweight material that attaches to earbud cables via permanently affixed cable-catches. The dual cable-catches enable attachment to a single earbud cable or in the case where small adaptor (pigtail cable components) are required; one catch can be used for the adaptor while the other catch maintains connection to the main earbud cable. The pouch becomes an integral part of the cable while remaining unobtrusive during use due to its lightweight and compact size. The pouch is designed to ease earbud cable management and simplified storage by using the reversible feature to completely envelop the earbud and associated cable(s) using the zipper closure.

Various alternative implementations may feature the following: (1) a compact textile design; zippered reversible pouch comprised of stretchable lightweight material to facilitate an unobtrusive attachment to earbud cable; (2) zippered, reversible and stretchable to ease collection of cable and completely envelop the desired cabled attachment; (3) two internally and permanently attached cable-catches; capable of attaching to and holding an individual cable or two separate cable components; and/or (4) successfully and completely enveloping the cable component within the disclosed invention; prevents entanglement with other stored objects.

The methods disclosed herein comprise one or more steps or actions for achieving the described method. The method steps and/or actions may be interchanged with one another without departing from the scope of the claims. In other words, unless a specific order of steps or actions is required for proper operation of the method that is being described, the order and/or use of specific steps and/or actions may be modified without departing from the scope of the claims. Moreover, the phrase "based on" does not mean "based only on," unless expressly specified otherwise. In other words, the phrase "based on" describes both "based only on" and "based at least on," or, if supported by the context, "based permissibly on."

Moreover, the flowcharts, block diagrams, and other structures shown and described herein are examples only, and other variants of these structures are also within the scope of the disclosure. Various modifications to these configurations are possible, and the generic principles presented herein may be applied to other configurations as well. Thus, the present disclosure is not intended to be limited to the configurations shown above but rather is to be accorded the widest scope consistent with the principles and novel features disclosed in any fashion herein, including in the attached claims as filed, which form a part of the original disclosure. As such, it should be noted that one or more of the features, functions, procedures, components, elements, structures, etc., described in connection with any one of the configurations, implementations, examples, or embodiments described herein may be combined with one or more of the functions, procedures, components, elements, structures, etc., described in connection with any of the other configurations, implementations, examples, or embodiments described herein, where compatible. In other words, any compatible combination of the functions, procedures, components, elements, etc., described herein may be implemented in accordance with the systems and methods disclosed herein.

Furthermore, unless indicated otherwise, any disclosure of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). The term "configuration" may be used in reference to a method, apparatus, and/or system as indicated by its particular context. The terms "method," "process," "procedure," and "technique" are used generically and interchangeably unless otherwise indicated by the particular context. The terms "apparatus" and "device" are also used generically and interchangeably unless otherwise indicated by the particular context. The terms "element" and "module" are typically used to indicate a portion of a greater configuration. Unless expressly limited by its context, the term "system" is used herein to indicate any of its ordinary meanings, including "a group of elements that interact to serve a common purpose."

Any incorporation by reference of a portion of a document shall also be understood to incorporate definitions of terms or variables that are referenced within the portion, where such definitions appear elsewhere in the document, as well as any figures referenced in the incorporated portion. Unless initially introduced by a definite article, an ordinal term (e.g., "first," "second," "third," etc.) used to modify a claim element does not by itself indicate any priority or order of the claim element with respect to another, but rather merely distinguishes the claim element from another claim element having a same name (but for use of the ordinal term). Unless expressly limited by its context, each of the terms "plurality" and "set" is used herein to indicate an integer quantity that is greater than one, whereas the term "subset" is used herein to indicate an integer quantity that is greater than or equal to one. Furthermore, in the above description reference numbers have sometimes been used in connection with various terms. Where a term is used in connection with a reference number, this may be meant to refer to a specific element that is shown in one or more of the Figures. Where a term is used without a reference number, this may be meant to refer generally to the term without limitation to any particular figure.

The previous description of the disclosure is provided to enable any person skilled in the art to make or use the disclosure. Various modifications to the disclosure will be readily apparent to those skilled in the art, and the generic principles defined herein may be applied to other variations without departing from the scope of the disclosure. Thus, the disclosure is not intended to be limited to the examples and designs described herein but is to be accorded the widest scope consistent with the principles and novel features disclosed herein. Furthermore, although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims that follow.

What is claimed:

1. An apparatus comprising:

a reversible pouch; and one or more attachments fixedly coupled to said reversible pouch for engaging a cable;

wherein said reversible pouch is capable of completely enveloping the cable and the attachments when in a standard configuration, and wherein said apparatus is capable of deploying substantially all of the cable through an opening in the reversible pouch while in the standard configuration; and wherein at least one attachment is a hook-and-loop fastener forming either a loop through which the cable passes and is engaged or a cover that permits a channel through which the cable passes and is engaged.

2. The apparatus of claim 1 wherein said apparatus is capable of maximally exposing the cable and the attachments when deployed in a reversible configuration.

3. The apparatus of claim 1 wherein the one or more attachments can be quickly disengaged from the cable.

4. The apparatus of claim 1 wherein the storage capacity of the pouch in a reversible configuration is substantially the same as the storage capacity of the pouch in the standard configuration.

5. The apparatus of claim 1 wherein the attachments is capable of covering less than ten percent (10%) of the cable when the cable is deployed in the standard configuration.

6. The apparatus of claim 1 wherein the reversible pouch is capable of covering less than twenty percent (20%) of the cable when the cable is deployed in the standard configuration.

7. The apparatus of claim 1 wherein the reversible pouch is capable of covering none of the cable when the cable is deployed in a reversible configuration.

8. The apparatus of claim 1 wherein the reversible pouch is capable of covering all of the cable when the cable is stored within the apparatus.

9. The apparatus of claim 1 wherein the attachment is fixedly coupled to the reversible pouch opposite the opening in the reversible pouch, or the attachment is fixedly coupled to the reversible pouch adjacent to the opening in the reversible pouch, or both.

10. The apparatus of claim 1 wherein the attachments comprise a cable-engaging surface that limits slippage of the apparatus when the cable is deployed in the standard configuration or in a reversible configuration.

11. The apparatus of claim 1 wherein a first attachment is capable of being disengaged from the cable while a second attachment remains engaged with the cable.

12. The apparatus of claim 1 wherein the exterior surface of the reversible pouch is marked with a first brand-identification and the interior surface of the reversible pouch is marked with a second brand-identification that is the same as or different than the first brand identification, wherein the first brand-identification comprising a name, a logo, an instruction, a disclaimer, a message, or a general marking, and wherein the second brand-identification comprising a name, a logo, an instruction, a disclaimer, a message, or a general marking.

13. The apparatus of claim 1 further comprising a separate storage compartment capable of storing an additional item.

14. The apparatus of claim 1 wherein the pouch is one of a zippered pouch, a hook-and-loop fastener pouch, a buttoned pouch, or a snapped pouch.

15. An apparatus comprising:

a reversible pouch; and one or more attachments fixedly coupled to said reversible pouch for engaging a cable for a headphone-type listening device;

wherein said reversible pouch is capable of completely enveloping the cable and the attachments when in a standard configuration, and wherein said apparatus is capable of deploying substantially all of the cable through an opening in the reversible pouch while in the standard configuration; and wherein the one or more attachments can be quickly disengaged from the cable, and wherein the storage capacity of the pouch in the reversible configuration is substantially the same as the storage capacity of the pouch in the standard configuration.

16. The apparatus of claim 15 wherein:

at least one attachment is a hook-and-loop fastener forming either a loop through which the cable passes and is engaged or a cover that permits a channel through which the cable passes and is engaged.

17. The apparatus of claim 15 wherein:

said apparatus is capable of maximally exposing the cable and the attachments when deployed in a reversible configuration;

the attachments are capable of covering less than ten percent (10%) of the cable when the cable is deployed in the standard configuration; and the reversible pouch is capable of covering less than twenty percent (20%) of the cable when the cable is deployed in the standard configuration.

18. An apparatus for augmenting a headphone-type listening device, the apparatus comprising:

a reversible pouch; and one or more attachments fixedly coupled to said reversible pouch for engaging a cable of said headphone-type listening device and capable of being quickly disengaged from the cable;

wherein said apparatus is capable of deploying substantially all of the cable through an opening in the reversible pouch while in the standard configuration, and capable of maximally exposing the cable and the attachments when deployed in a reversible configuration;

wherein said reversible pouch is capable of completely enveloping the cable and the attachments when in a standard configuration, wherein the storage capacity of the reversible pouch in the reversible configuration is substantially the same as the storage capacity of the reversible pouch in the standard configuration, wherein the reversible pouch is a zippered pouch, a hook-and-loop fastener pouch, a buttoned pouch, or a snapped pouch;

wherein at least one attachment is a hook-and-loop fastener forming either a loop through which the cable passes and is engaged or a cover that permits a channel through which the cable passes and is engaged, wherein the attachment is fixedly coupled to the reversible pouch opposite the opening in the reversible pouch, or the attachment is fixedly coupled to the reversible pouch adjacent to the opening in the reversible pouch, or both;

wherein the attachments comprise a cable-engaging surface that limits slippage of the apparatus when the cable is deployed in the standard configuration or in the reversible configuration; and wherein the attachments are capable of covering less than ten percent (10%) of the cable when the cable is deployed in the standard configuration, wherein the reversible pouch is capable of covering less than twenty percent (20%) of the cable when the cable is deployed in the standard configuration and covering none of the cable when the cable is deployed in the reversible configuration, and wherein the reversible pouch is capable of covering all of the cable when the cable is stored within the apparatus.

19. The apparatus of claim 15 wherein the reversible pouch is a zippered pouch, a hook-and-loop fastener pouch, a buttoned pouch, or a snapped pouch.

20. The apparatus of claim 15 wherein:

the reversible pouch is capable of covering none of the cable when the cable is deployed in the reversible configuration; and wherein the reversible pouch is capable of covering all of the cable when the cable is stored within the apparatus.

* * * * *